United States Patent [19]

Vits

[11] 4,286,756

[45] Sep. 1, 1981

[54] CONTINUOUS UNCOILER FOR COILS OF WEB LENGTHS

[75] Inventor: Hilmar Vits, Leichlingen, Fed. Rep. of Germany

[73] Assignee: Vits Maschinenbau GmbH, Langenfeld, Fed. Rep. of Germany

[21] Appl. No.: 132,106

[22] Filed: Mar. 20, 1980

[30] Foreign Application Priority Data

Mar. 22, 1979 [DE] Fed. Rep. of Germany ..... 2911268

[51] Int. Cl.[3] ..... B65H 19/18

[52] U.S. Cl. ..... 242/58.1; 242/58.5

[58] Field of Search ..... 242/58.1, 58.2, 58.3, 242/58.4, 58.5; 156/504

[56] References Cited

U.S. PATENT DOCUMENTS

| | | | |
|---|---|---|---|
| 3,172,613 | 3/1965 | Simons | 242/58.2 |
| 3,233,526 | 2/1966 | Sherman | 242/58.1 X |
| 4,111,741 | 9/1978 | Paul | 242/58.1 |
| 4,238,261 | 12/1980 | Tetro | 242/58.2 |

*Primary Examiner*—Edward J. McCarthy

*Attorney, Agent, or Firm*—Kenyon & Kenyon

[57] ABSTRACT

A continuous uncoiler for coils of web lengths adhesively connects the web of an exhausting coil on and overlapping the front web of a new supply coil and a rip cord behind the adhesive is pulled to rip off the residual portion of the overlapping web behind the adhesive.

5 Claims, 9 Drawing Figures

Fig.1
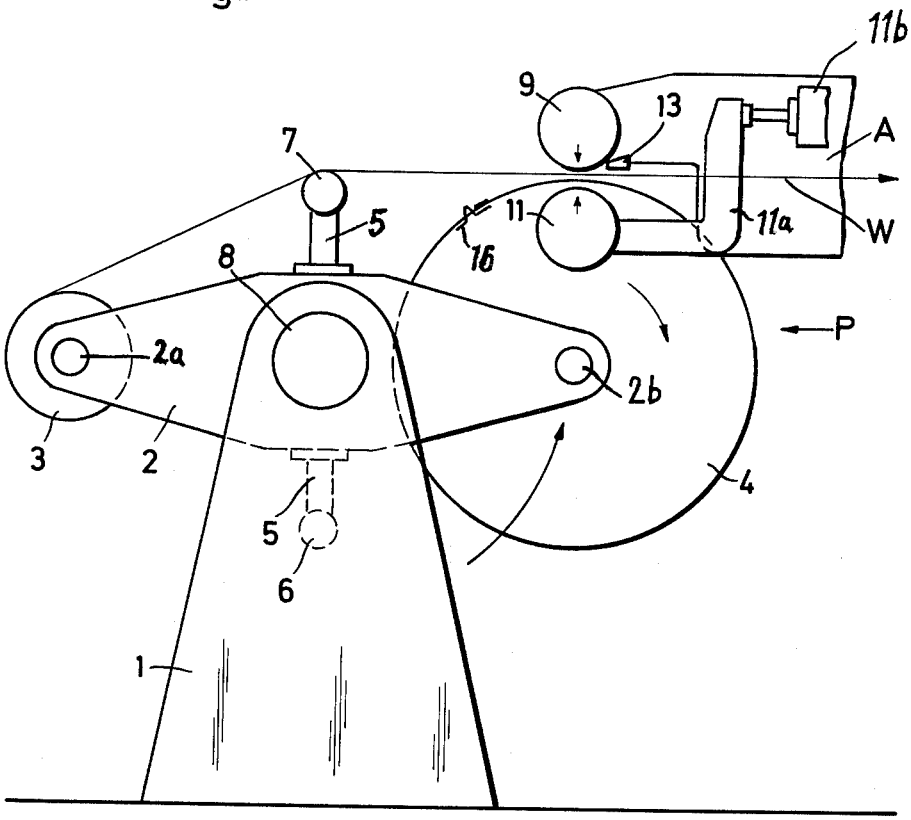
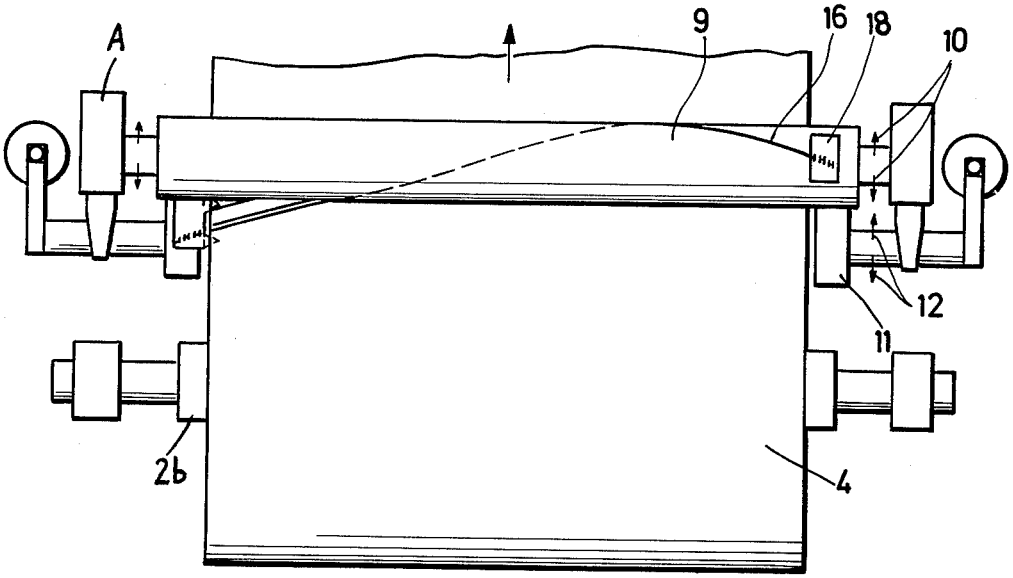
Fig.2

CONTINUOUS UNCOILER FOR COILS OF WEB LENGTHS

BACKGROUND OF THE INVENTION

A continuous uncoiler for coils of web lengths of material, such as paper, can provide a continuous supply of the web to processing equipment including a continuous cross-cutter cutting the web into a succession of sheets.

Characteristically such an uncoiler provides means for rotatively mounting one coil so its web length can be continuously pulled forwardly so as to form a continuously feeding span, together with means for rotatively mounting a second coil axially parallel to the first coil and so as to be overlapped by the span feeding from the first coil. For continuous action, when the first coil approaches exhaustion, the last portion of its web is connected to the front end of the second coil's web length so that without interruption the second coil continues with the web feeding.

It follows that the interconnection between the exhausting and new coil webs must be effected while they continuously travel forwardly. An apparently simple way to do this is to first apply a transverse strip of pressure-sensitive adhesive to the outside of the front end of the web of the second coil so that by pressing the overlapping traveling web from the first or exhausting coil against the second coil's periphery, rotation of the second roll effects the connection adhesively. The coils can be mounted by spindles rotatively powered to control web tension to the value required for span tautness without web breakage and to rotate the second coil to bring the strip of adhesive into position for contact by the overlapping web. The second coil is normally brought to a peripheral velocity equalling the linear velocity of the continuously pulled web.

The interconnection between the webs must be made before the trailing end of the web from the first or exhausting coil leaves that coil's spindle because there must be some web backtensioning to maintain the span of web overlapping the second or new roll. Consequently, there is a residual portion of the overlapping web left trailing behind the interconnection made by the adhesive. This forms a tail that should be cut off neatly and as close as possible to the adhesive interconnection, to avoid trouble at the processing equipment.

The cut-off can be made by a flying knife which while cutting travels momentarily with the traveling webs. For precision control of the knife, computors have been used intended to take into consideration the web velocity, the position of the adhesive interconnection and the response time of the flying knife. The initial and servicing costs of such precision control are high and they are not always affordable. It is not uncommon to actually stop what should be a continuous unwinder so that the tail of web can be manually cut neatly and close to the adhesive interconnection. This requires stoppage of the processing equipment which should be fed continuously by the web lengths.

SUMMARY OF THE INVENTION

The present invention provides a simple, inexpensive and very reliable solution to the problem of removing the tail behind the adhesive interconnection between the exhausting and new web ends without stopping the continuity of the unwinding of the web coils.

This is done by a rip cord positioned on the web of the second or new coil in back of its strip of adhesive and providing the unwinder with a means for pulling the cord immediately after the adhesion between the webs. At this time the trailing end of the exhausting web has not yet left its coil and is still forming a taut span so the rip-off is clean. The rip, or cut, is inherently made precisely behind the adhesive interconnection.

Precision control of this cut-off is made unnecessary. With the adhesive strip and rip cord positioned just ahead of their point of contact by the overlapping traveling web, the second or new coil has available almost a 360° rotation for bringing it to the peripheral velocity matching the traveling web linear velocity.

This new concept has resulted in the invention of a new continuous unwinder which is illustrated by the accompanying drawings and described in detail hereinbelow.

DESCRIPTION OF THE DRAWINGS

The drawings schematically illustrate the new unwinder, the various figures being as follows:

FIG. 1 is a side elevation;

FIG. 2 is an end view looking in the direction indicated by the arrow P in FIG. 1;

DETAILED DESCRIPTION OF THE INVENTION

Figure 3:
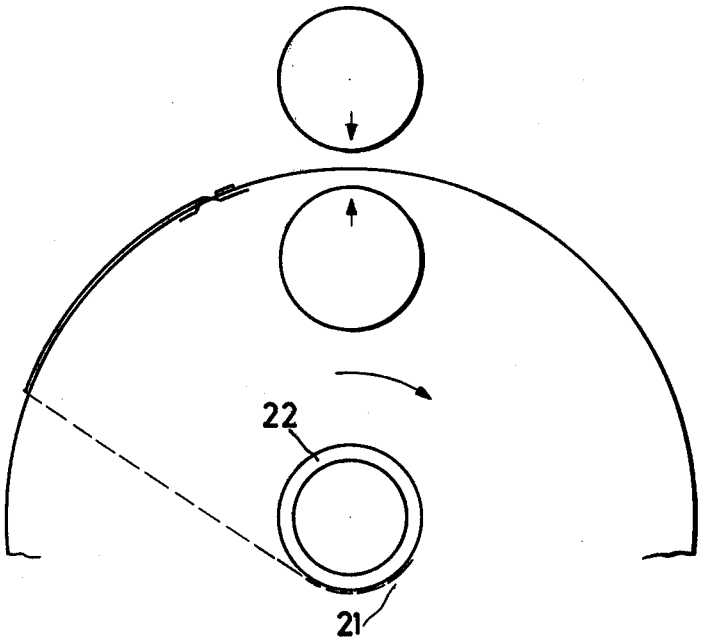
FIG. 3 in side elevation shows how the back end of the rip cord can be anchored.

The above drawings illustrate the new winder as comprising a stand 1 journaling a double-armed coil spindle mounting arm 2 on the opposite ends of which are the two rotative spindles **2*a* and 2*b*, respectively. Although not shown, it is to be understood that these spindles are rotatively powered as usual. The actively feeding, exhausting web length coil is shown at 3 on the spindle 2*a* and the now inactive new coil 4 is on the spindle 2*b*. The mounting arm 2 has right angularly extending arms 5 respectively mounting guide rollers 6 and 7. The axes of the guide rollers and of the spindles are all parallel with respect to each other, as is the axis of the bearing shaft 8 about which the double-armed mounting 2 can rotate, and again as usual the rotation of the arm 2** between its operating positions is power-actuated by an arrangement not illustrated.

In FIG. 1 the web W is pulled over the guide rollers 7 from the exhausting coil 3 so as to form a span of controlled tautness overlapping the periphery of the coil 3 and spaced thereabove.

Above the overlapping span of web a pressure roller 9 is journaled by a bracket A which moves up and down so that the roller can press the web span downward and against the periphery of the coil 4. This roller 9 is mounted vertically above and parallel to the spindle **2*b* in FIG. 1, with the understanding that the same relationship prevails when the spindle 2*a* in position replaces the position of the spindle 2*b*. This action is accommodated because the bracket A can be moved away from its illustrated position. The arrows 10 in FIG. 2** are intended to indicate such displacement.

The pressure roller 9 extends beyond the coil and web W, and when moved downwardly by its mounting bracket A, presses the overlapping span against the periphery of the coil 4.

The bracket A also mounts a wheel 11 beneath the roller 9 via a bell crank 11*a* which can be rocked so that the wheel contacts the roller 9, by a thrustor 11*b*. The bracket A also mounts a strip-like support element 13 which extends for the width of the web W into the gap between the pressure roller 9 and the periphery of the coil 4.

Figure 4:
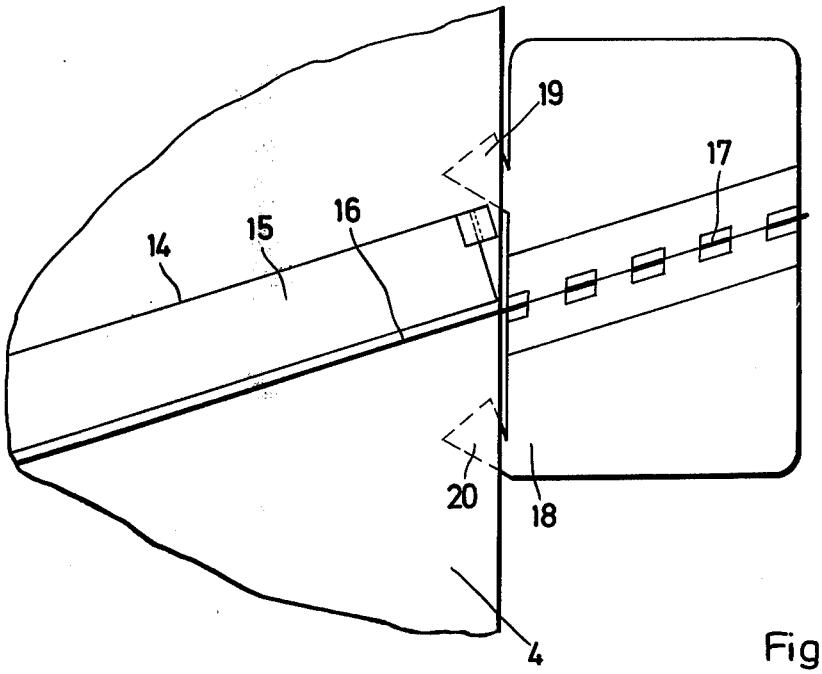
FIG. 4 on a substantially enlarged scale shows how the front end of the rip cord can be gripped for pulling.
Figure 5:
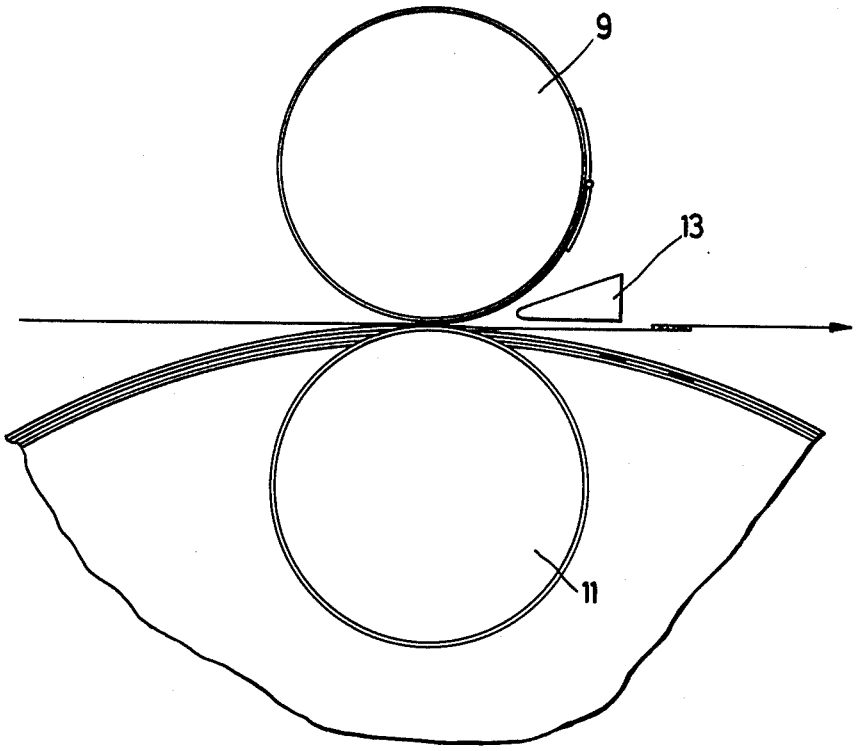
FIG. 5 on an enlarged scale shows a detail taken from FIG. 1.
Figure 6:
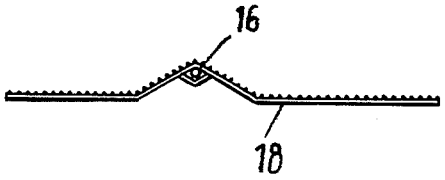
FIG. 6 is a side view showing a connection for the front end of the rip cord.

As shown in FIGS. 2 and 4, the front edge 14 of the web of the coil 4 is cut diagonally or slanted as contrasted to a right angle cut, and the strip of adhesive 15 correspondingly extends diagonally transversely across the web with its front boundary at this edge. At the other or back boundary of adhesive strip 15, the rip cord 16 extends transversely across the coil. This rip cord can be made of wire, plastic or other material suitable for ripping the web.

The front end or start 17 of the rip cord 15 is fastened to a plug-in card 18 which, as shown by FIG. 4, has tear-off tips 19 and 20 which are inserted or plugged in and between the outer convolutions of the web of the roll 4. This plug-in card has a pressure-sensitive adhesive on its outer side facing the pressure roller 9 when registered with the latter. The other end 21 of the rip cord is brought down radially over the other end of the coil 4 and adhesively fixed to the projecting end 22 of the spindle 2*b*.

The operation is as follows:

Just safely before the trailing end of the web from the coil 3 disengages, and assuming that the coil 4 positions the adhesive strip 15, rip cord 16 and plug-in card 18 just safely in front of the pressure roller 9, the spindle 2*b* is started on its rotation towards its proper peripheral speed, the bracket A is moved so the pressure roller 9 presses the web W against the periphery of the coil 4, and the bell crank 11*a* is rocked so that the wheel 11 is pressed upwardly against the free projecting end of the roller 9.

In FIG. 1, as indicated by the showing of the plug-in card 16, this card is about to enter the nip formed between the wheel 11 and the projecting end of the pressure roller 9. When it does make this entry, its adhesive side is pressed against the roller 9 by the wheel 11 so the card adhesively attaches to the roller 9 which by its rotation pulls the card in an almost right angular direction away from the web on the coil 4. The support element 13 holds the web against upward displacement. Because the rip card is behind the adhesive strip 15, the pressure roller 9 has already pressed the web W against this strip to effect the interconnection between the two webs, so the rip-off of the web W occurs immediately behind the adhesive interconnection. The adhesive connection of the plug-in card 16 with the pressure roller 9 also results in the latter pulling up and rolling up or reeling in the entire length of rip cord, the cord's end 21 pulling loose from the projecting spindle end 22, the rolled up cord and its card being subsequently removed prior to the need for another coil change.

Because the adhesive strip 15 and rip cord 16 extend diagonally across the web of the coil 4, the action described is progressive from one side of the ripping web to the other as it would be for normal rip cord operation. Another advantage is that the interconnection of overlapped webs extends diagonally or slants so that if for processing of the web it must be cut transversely by a flying knife, the knife does not have to cut through the entire length of the overlapped parts transversely of the web. The cut is made diagonally through the overlapped interconnected parts.

After the web coil 4 is feeding, and the bracket A is moved out of the way, the double-armed spindle mounting 2 can be rotated so that the web feeding from the coil 4 is guided over the other guide roller 6 and the coil occupies the position of the coil 3. Now the spindle 2*a* can be supplied with a new full coil of web length.

Figure 7:
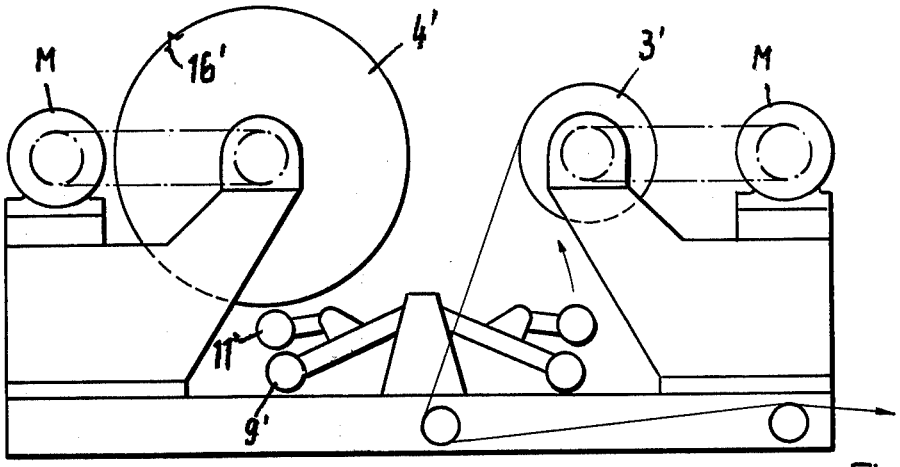
FIG. 7 is a side view showing a modification of the unwinder.

A continuous uncoiler of the type shown by FIGS. 1 and 2 is relatively expensive. However, the principles of the present invention are applicable to two stationary uncoiling devices as shown by FIG. 7. This is a less expensive application even though there must be two pressure cylinders and two of the wheels 11. The parts are numeraled with primed numbers which otherwise correspond to those used before to identify the corresponding parts.

Figure 8:
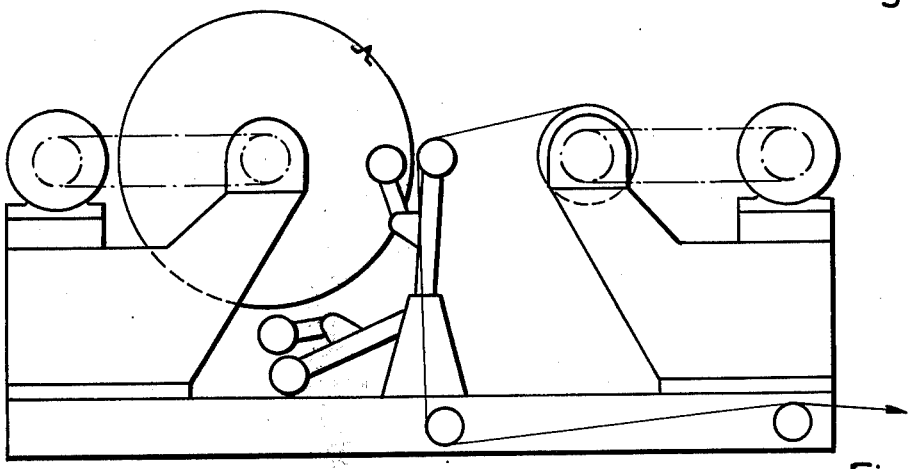
FIGS. 8 and 9 correspond to FIG. 7 but show different operational phases.
Figure 9:
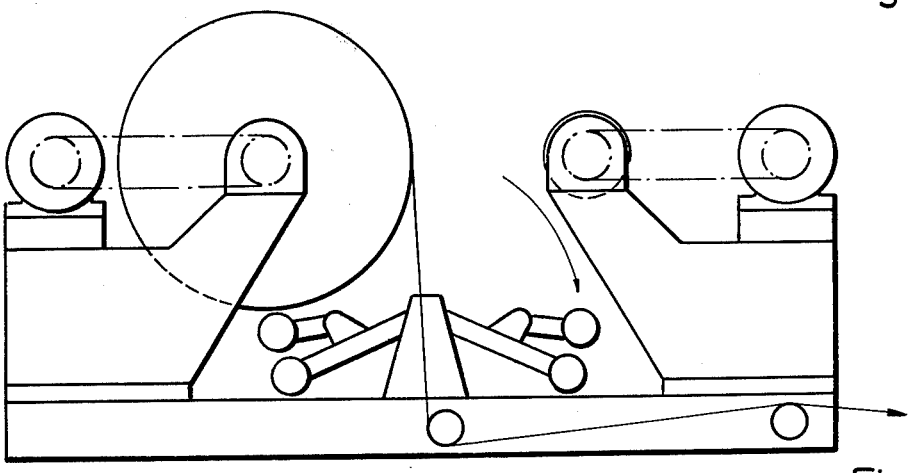

To illustrate the action of this modification, FIG. 7 shows the starting situation, while FIG. 8 shows the action immediately before and FIG. 9 immediately after the adhesive interconnection of the webs.

In the case of this modification, the spindle-rotating motors, not illustrated in the case of the figures showing the first form, are illustrated and marked M. As usual, the rotation of the coils should be controlled to apply a back tension on the web without tearing the web apart or pulling apart the adhesive interconnection of the web ends.

In all cases without using a knife and its complications or necessarily using any kind of timing equipment, the rip cord rips or cuts the tail or residual portion of the overlapping web from exactly behind the back boundary of the strip of adhesive. The severing action is entirely mechanical and cannot occur inaccurately. In addition, there is the advantage that the overlapped parts forming the interconnection extend diagonally with respect to the web so that subsequent transverse cutting of the web during its further processing reduces the load on the knife necessarily used, as compared to the load resulting if the cut is made through the doubled-web layers for the full width of the web.

What is claimed is:

1. A continuous uncoiler for coils of web lengths and comprising means for rotatively mounting a first coil so its web length can be continuously pulled forwardly and form a continuously feeding span, means for rotatively mounting a second coil axially parallel to the first coil and so as to be opposite to said span, the front end of the second coil's web length having a transverse strip of adhesive and a rip cord behind and parallel to this strip, and pressing means for pressing said span against the second roll so that by rotation of the second coil the first coil's web length becomes adhesively fixed to the front end of the second coil's web length and pulls this front end forwardly with said trailing end overlapping said front end and having a portion extending behind said adhesive strip and over said rip cord, and pulling means for pulling the rip cord so as to rip off said portion.

2. The uncoiler of claim 1 in which said strip of adhesive and said rip cord extend diagonally across said web length.

3. The uncoiler of claim 1 in which said pressing means comprises a pressure roller which presses said span towards said second roll, and said pulling means comprises an end of said roller projecting beyond a side edge of said span and a wheel which is pressed against said end of said roller, said rip cord having an adhesive and positioned to be pressed against said end of said roller by said wheel so that by adhesion to said roller the latter rolls up said rip cord.

4. The uncoiler of claim 3 in which said adhesive end of said cord is formed by a plug-in card having tear-off parts inserted in the end of the web of said second coil and having an adhesive side facing said roller.

5. The uncoiler of claims 1, 2, 3 or 4 having means for holding said span against substantial displacement in the direction said rip cord is pulled.

* * * * *